US009812082B2

(12) United States Patent
Chen et al.

(10) Patent No.: US 9,812,082 B2
(45) Date of Patent: Nov. 7, 2017

(54) PIXEL CIRCUIT, DRIVING METHOD, DISPLAY PANEL AND DISPLAY DEVICE

(71) Applicants: Shanghai Tianma AM-OLED Co., Ltd., Shanghai (CN); Tianma Micro-Electronics Co., Ltd., Shenzhen (CN)

(72) Inventors: Dan Chen, Shanghai (CN); Dong Qian, Shanghai (CN); Hanyu Gu, Shanghai (CN)

(73) Assignees: SHANGHAI TIANMA AM-OLED CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 267 days.

(21) Appl. No.: 14/884,442

(22) Filed: Oct. 15, 2015

(65) Prior Publication Data

US 2016/0189606 A1 Jun. 30, 2016

(30) Foreign Application Priority Data

Dec. 30, 2014 (CN) ..... 2014 1 0857191

(51) Int. Cl.

| | |
|---|---|
| ***G09G 3/36*** | (2006.01) |
| ***G09G 3/32*** | (2016.01) |
| ***G09G 3/3233*** | (2016.01) |
| *G09G 3/3283* | (2016.01) |

(52) U.S. Cl.

CPC ..... *G09G 3/3659* (2013.01); *G09G 3/3233* (2013.01); *G09G 3/3283* (2013.01); *G09G 2300/0819* (2013.01); *G09G 2300/0842* (2013.01); *G09G 2300/0861* (2013.01); *G09G 2320/0233* (2013.01); *G09G 2320/043* (2013.01)

(58) Field of Classification Search

CPC ..... G09G 3/3659; G09G 3/3233

See application file for complete search history.

(56) References Cited

U.S. PATENT DOCUMENTS

| | | | | |
|---|---|---|---|---|
| 8,547,372 | B2 | 10/2013 | Chung et al. | |
| 9,153,167 | B2 * | 10/2015 | Choi | G09G 3/3225 |
| 2007/0063962 | A1 * | 3/2007 | Nanataki | G02F 1/133602 345/102 |

(Continued)

FOREIGN PATENT DOCUMENTS

| | | |
|---|---|---|
| CN | 101251977 A | 8/2008 |
| CN | 103778883 A | 5/2014 |

OTHER PUBLICATIONS

Chinese Application No. 201410857191.3, First Office Action issued Dec. 14, 2016.

*Primary Examiner* — Patrick Edouard
*Assistant Examiner* — Maheen Javed
(74) *Attorney, Agent, or Firm* — Alston & Bird LLP

(57) ABSTRACT

The application provides a pixel circuit, a driving method, a display panel and a display device. The pixel circuit includes a first transistor, a second transistor, a third transistor, a fourth transistor, a fifth transistor, a sixth transistor, a driving transistor, a storage capacitor and a light emitting element, and by cooperative driving of the respective transistors and the storage capacitor, the driving current of the driving transistor can be independent of the gate-source voltage and the threshold voltage of the driving transistor.

19 Claims, 2 Drawing Sheets

(56) References Cited

U.S. PATENT DOCUMENTS

| | | | | |
|---|---|---|---|---|
| 2007/0109232 | A1 | 5/2007 | Yamamoto et al. | |
| 2007/0126680 | A1 | 6/2007 | Han et al. | |
| 2008/0150846 | A1* | 6/2008 | Chung | G09G 3/3233 345/80 |
| 2015/0154906 | A1* | 6/2015 | Chung | G09G 3/3233 345/212 |
| 2016/0071458 | A1* | 3/2016 | Tan | G09G 3/3233 345/212 |

* cited by examiner

PIXEL CIRCUIT, DRIVING METHOD, DISPLAY PANEL AND DISPLAY DEVICE

CROSS REFERENCE TO RELATED APPLICATIONS

This application claims priority to Chinese patent application No. 201410857191.3, titled "PIXEL CIRCUIT, DRIVING METHOD, DISPLAY PANEL AND DISPLAY DEVICE" and filed with the Chinese State Intellectual Property Office on Dec. 30, 2014, the contents of which are hereby incorporated by reference in their entirety.

BACKGROUND

The Organic Light Emitting Display (OLED) refers to a phenomenon that luminescence occurs by injection and recombination of carriers when an organic semiconductor material and a luminescent material are driven by an electric field, and the principle of using an ITO transparent electrode and a metal electrode as an anode and a cathode of a device respectively, electrons and holes are injected respectively from the cathode and the anode into the electron transport layer and the hole transport layer under the driving of a certain voltage, and when the electrons and holes migrate to the light emitting layer via the electron transport layer and the hole transport layer and meet in the light emitting layer, excitons are formed and light molecules are formed by excitation, thereby forming excitation light.

Organic light emitting display devices became a hot research topics in the field of display devices due to features associated with organic light emitting displays including fast response times and low power consumption. However, a phenomenon of non-uniformity display of a display image exists in organic light emitting display devices conventionally.

BRIEF SUMMARY

This disclosure relates to organic light emitting displays, and particularly to a pixel circuit, a driving method, a display panel and a display device including the display panel.

Embodiments of the disclosure provide a pixel circuit, a driving method, a display panel and a display device including the display panel, with which the non-uniformity display of a display image of the organic light emitting display device is relieved and the display effect of the organic light emitting display device is improved.

A pixel circuit is provided, which includes a first transistor, a second transistor, a third transistor, a fourth transistor, a fifth transistor, a sixth transistor, a driving transistor, a storage capacitor and a light emitting element, where a magnitude of a driving current of the driving transistor is determined by a gate-source voltage of the driving transistor; the first transistor is controlled by a first driving signal and is configured to transmit a first power supply signal to a drain of the driving transistor; the second transistor is controlled by a first scanning signal and is configured to transmit the first power supply signal to a first plate of the storage capacitor and a gate of the driving transistor; the third transistor is controlled by a second scanning signal and is configured to transmit a data signal to a source of the driving transistor; the fourth transistor is controlled by a second driving signal and is configured to transmit a voltage of the source of the driving transistor to a second plate of the storage capacitor; the fifth transistor is controlled by the first scanning signal and is configured to transmit a first reference voltage to the second plate of the storage capacitor; the sixth transistor is controlled by the second scanning signal and is configured to transmit the driving current from the driving transistor to an anode of the light emitting element; a cathode of the light emitting element is connected to a second power supply signal, and the light emitting element is configured to emit light in response to the driving current.

An embodiment of the disclosure further provides a driving method for driving a pixel circuit, where the pixel circuit includes a first transistor, a second transistor, a third transistor, a fourth transistor, a fifth transistor, a sixth transistor, a driving transistor, a storage capacitor and a light emitting element, where a magnitude of a driving current of the driving transistor is determined by a gate-source voltage of the driving transistor; the first transistor is controlled by a first driving signal and is configured to transmit a first power supply signal to a drain of the driving transistor; the second transistor is controlled by a first scanning signal and is configured to transmit the first power supply signal to a first plate of the storage capacitor and a gate of the driving transistor; the third transistor is controlled by a second scanning signal and is configured to transmit a data signal to a source of the driving transistor; the fourth transistor is controlled by a second driving signal and is configured to transmit a voltage of the source of the driving transistor to a second plate of the storage capacitor; the fifth transistor is controlled by the first scanning signal and is configured to transmit a first reference voltage to the second plate of the storage capacitor; the sixth transistor is controlled by the second scanning signal and is configured to transmit the driving current from the driving transistor to an anode of the light emitting element; and a cathode of the light emitting element is connected to a second power supply signal, and the light emitting element is configured to emit light in response to the driving current, and where the driving method includes a reset stage, a threshold compensation stage and a light emitting stage, where in the reset stage, the first power supply signal is transmitted to the gate and the drain of the driving transistor; in the threshold compensation stage, the data signal is transmitted to the first plate of the storage capacitor, and the gate-source voltage of the driving transistor is controlled by the storage capacitor to remain constant, so that the data signal is transmitted to the source of the driving transistor; and in the light emitting stage, the driving transistor generates a driving current to drive the light emitting element to emit light.

An embodiment of the disclosure further provides a display panel including: pixel units arranged in an M×N array, multiple scanning lines, multiple data lines, multiple power supply signal lines, where M and N are positive integers, the pixel unit includes a pixel circuit, and the pixel circuit includes a first transistor, a second transistor, a third transistor, a fourth transistor, a fifth transistor, a sixth transistor, a driving transistor, a storage capacitor and a light emitting element, where magnitude of a driving current of the driving transistor is determined by a gate-source voltage of the driving transistor; the first transistor is controlled by a first driving signal and is configured to transmit a first power supply signal to a drain of the driving transistor; the second transistor is controlled by a first scanning signal and is configured to transmit the first power supply signal to a first plate of the storage capacitor and a gate of the driving transistor; the third transistor is controlled by a second scanning signal and is configured to transmit a data signal to a source of the driving transistor; the fourth transistor is controlled by a second driving signal and is configured to transmit a voltage of the source of the driving transistor to a second plate of the storage capacitor; the fifth transistor is controlled by the first scanning signal and is configured to transmit a first reference voltage to the second plate of the storage capacitor; the sixth transistor is controlled by the second scanning signal and is configured to transmit the driving current from the driving transistor to an anode of the light emitting element; and a cathode of the light emitting element is connected to a second power supply signal, and the light emitting element is configured to emit light in response to the driving current, the scanning lines are parallel to a row direction of pixels; the data lines are parallel to a column direction of pixels; each of the pixel units is electrically connected with four scanning lines, one data line and two power supply signal lines; and the four scanning lines are configured to supply the first scanning signal, the second scanning signal, the first driving signal and the second driving signal to the pixel unit; the data line is configured to supply the data signal to the pixel unit; the two power supply signal lines are configured to supply the first power supply signal and the second power supply signal to the pixel unit.

An embodiment of the disclosure further provides a display device including a display panel, the display panel includes: pixel units arranged in an M×N array, a plurality of scanning lines, a plurality of data lines, a plurality of power supply signal lines, wherein M and N are positive integers, where the pixel unit includes a pixel circuit, and the pixel circuit includes a first transistor, a second transistor, a third transistor, a fourth transistor, a fifth transistor, a sixth transistor, a driving transistor, a storage capacitor and a light emitting element, wherein a magnitude of a driving current of the driving transistor is determined by a gate-source voltage of the driving transistor; the first transistor is controlled by a first driving signal and is configured to transmit a first power supply signal to a drain of the driving transistor; the second transistor is controlled by a first scanning signal and is configured to transmit the first power supply signal to a first plate of the storage capacitor and a gate of the driving transistor; the third transistor is controlled by a second scanning signal and is configured to transmit a data signal to a source of the driving transistor; the fourth transistor is controlled by a second driving signal and is configured to transmit a voltage of the source of the driving transistor to a second plate of the storage capacitor; the fifth transistor is controlled by the first scanning signal and is configured to transmit a first reference voltage to the second plate of the storage capacitor; the sixth transistor is controlled by the second scanning signal and is configured to transmit the driving current from the driving transistor to an anode of the light emitting element; and a cathode of the light emitting element is connected to a second power supply signal, and the light emitting element is configured to emit light in response to the driving current, the scanning lines are parallel to a row direction of pixels; the data lines are parallel to a column direction of pixels; each of the pixel units is electrically connected with four scanning lines, one data line and two power supply signal lines; and the four scanning lines are configured to supply the first scanning signal, the second scanning signal, the first driving signal and the second driving signal to the pixel unit; the data line is configured to supply the data signal to the pixel unit; the two power supply signal lines are configured to supply the first power supply signal and the second power supply signal to the pixel unit.

The pixel circuit according to the embodiment of the disclosure includes a first transistor, a second transistor, a third transistor, a fourth transistor, a fifth transistor, a sixth transistor, a driving transistor, a storage capacitor and a light emitting element, and by cooperated driving of the respective transistors and the storage capacitor, the driving current of the driving transistor can be independent of the gate-source voltage and the threshold voltage of the driving transistor, thereby eliminating bad effects, relieving non-uniformity luminance of the display panel and the display device, and improving luminance uniformity and display effect of the display image of the display panel and the display device.

BRIEF DESCRIPTION OF THE DRAWINGS

In order to more clearly illustrate embodiments of the disclosure or conventional technical solutions, drawings to be used in the description of the embodiments or the conventional technical solutions will be introduced briefly hereinafter. Apparently, the drawings in the following description are merely embodiments of the disclosure, and other drawings can be obtained from the provided drawings by those skilled in the art without any creative efforts.

DETAILED DESCRIPTION OF VARIOUS EMBODIMENTS

Figure 1:
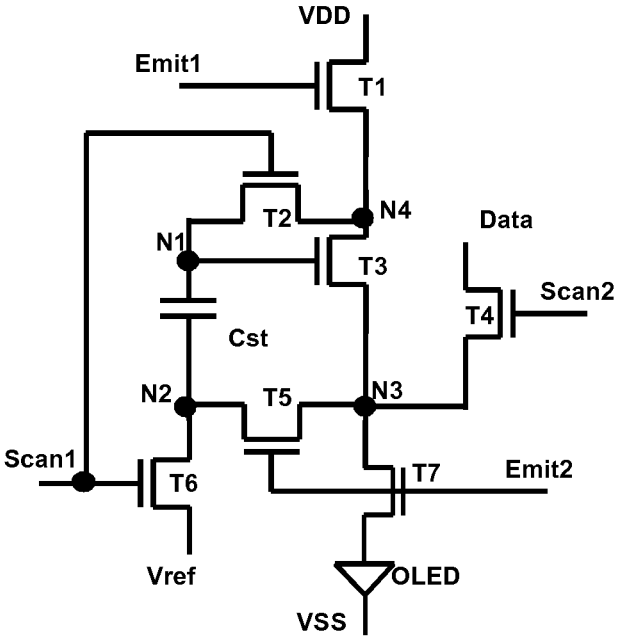
FIG. 1 is a schematic diagram of a circuit structure of a pixel circuit according to an embodiment of the disclosure.

The technical solutions in the embodiments of the disclosure will be described clearly and fully hereinafter in conjunction with the drawings in the embodiments of the disclosure. Apparently, the embodiments described are merely a few of embodiments of the disclosure, rather than all embodiments. All other embodiments obtained by those skilled in the art based on the embodiments of the disclosure without any creative efforts fall within the scope of protection of the disclosure.

As described in the background section, there is a phenomenon of non-uniformity display of a display image of the organic light emitting display device conventionally.

By research, the inventor found that the driving current of the light emitting element in the organic light emitting display device is in direct proportional to the square of the difference between the gate-source voltage and the threshold voltage of the driving transistor of the light emitting element, i.e., $Ioled \propto (Vgs-Vth)^2$, where Ioled represents the driving current of the light emitting device, Vgs represents the gate-source voltage of the driving transistor of the light emitting element, and Vth represents the threshold voltage of the driving transistor of the light emitting element.

In the conventional technology, the driving transistor of the pixel circuit of the organic light emitting display device generally includes a TFT (Thin Film transistor) which may comprise LTPS (Low Temperature Poly-silicon) material, a-Si (amorphous silicon) material, oxide material, and/or the like. No matter what kind of material is used to form the TFT, there may be a non-uniform phenomenon of the threshold voltage Vth of the driving transistor of the pixel circuit due to processing technology, device aging and other reasons, which leads to deviation in the current flowing through each OLED pixel points, causes the non-uniformity of the entire display image, and thus affects the display effect of the entire display image.

In addition, in a large-sized organic light emitting display device, because the anode power supply line of the organic light emitting display device has a certain resistance and the driving current of all the pixel units is supplied by the same power supply line, the power supply voltage at the position close to the power supplying source is higher than the power supply voltage at the position far away from the power supplying source in the display device, that is, the voltage on the anode power supply line decreases as the distance from the power supplying source increases. The driving of the organic light emitting display device depends on current driving, and the current is directly related to the power supply voltage, therefore, difference in current among different regions in the organic light emitting display device exists, and thus a phenomenon of non-uniformity of luminance at different regions in the display image of the organic light emitting display device occurs.

In addition, the OLED element is aging in using of the organic light emitting display device, that is, the voltage-luminance characteristic of the OLED changes over time, which leads to a phenomenon that the display image of the display device dims.

In view of this, an embodiment of the disclosure provides a pixel circuit. As shown in FIG. 1, the pixel circuit includes a first transistor T1, a second transistor T2, a third transistor T4, a fourth transistor T5, a fifth transistor T6, a sixth transistor T7, a driving transistor T3, a storage capacitor Cst and a light emitting element OLED. The magnitude of the driving current of the driving transistor T3 is determined by a gate-source voltage of the driving transistor T3.

In the embodiment, the first transistor T1 is controlled by a first driving signal Emit1, for transmitting a first power supply signal VDD to the drain of the driving transistor T3; the second transistor T2 is controlled by a first scanning signal Scan1, for transmitting the first power supply signal VDD to a first plate of the storage capacitor Cst and the gate of the driving transistor T3; the third transistor T4 is controlled by a second scanning signal Scan2, for transmitting a data signal Data to the source of the driving transistor T3; the fourth transistor T5 is controlled by a second driving signal Emit2, for transmitting a voltage of the source of the driving transistor T3 to a second plate of the storage capacitor Cst; the fifth transistor T6 is controlled by the first scanning signal Scan1, for transmitting a first reference voltage Vref to the second plate of the storage capacitor Cst; the sixth transistor T7 is controlled by the second driving signal Emit2, for transmitting the driving current from the driving transistor T3 to an anode of the light emitting element OLED; a cathode of the light emitting element OLED is electrically connected to a second power supply signal VSS, and the light emitting element emits light in response to the driving current. Preferably, the light emitting element OLED is an organic light emitting diode, but the disclosure has no limitation to this, which depends on the specific conditions.

On the basis of the above-described embodiment, in an embodiment of the disclosure, the gate of the first transistor T1 is provided with the first driving signal Emit1, a first electrode of the first transistor T1 is provided with the first power supply signal VDD, and a second electrode of the first transistor T1 is electrically connected to a fourth node N4; the gate of the second transistor T2 is provided with the first scanning signal Scan1, a first electrode of the second transistor T2 is electrically connected to a first node N1, and a second electrode of the second transistor T2 is electrically connected to the fourth node T4; the gate of the driving transistor T3 is electrically connected to the first node N1, the drain of the driving transistor T3 is electrically connected to the fourth node N4, and the source of the driving transistor T3 is electrically connected to a third node N3; the gate of the third transistor T4 is provided with the second scanning signal Scan2, a first electrode of the third transistor T4 is provided with the data signal Data, and a second electrode of the third transistor T4 is electrically connected to the third node T3; the gate of the fourth transistor T5 is provided with the second driving signal Emit2, a first electrode of the fourth transistor T5 is electrically connected to the second node N2, and a second electrode of the fourth transistor T5 is electrically connected to the third node T3; the gate of the fifth transistor T6 is provided with the first scanning signal Scan1, a first electrode of the fifth transistor T6 is electrically connected to the second node N2, and a second electrode of the fifth transistor T6 is provided with the first reference voltage Vref; the gate of the sixth transistor T7 is provided with the second driving signal Emit2, a first electrode of the sixth transistor T7 is electrically connected to the third node T3, and a second electrode of the sixth transistor T7 is electrically connected to the anode of the light emitting element OLED, and the cathode of the light emitting element OLED is provided with the second power supply signal VSS; the first plate of the storage capacitor Cst is electrically connected to the first node N1, and the second plate of the storage capacitor Cst is electrically connected to the second node N2.

On the basis of the above-described embodiments, in an embodiment of the disclosure, the driving transistor T3 is an N-type transistor. In an implementation, all of the first transistor T1, the second transistor T2, the third transistor T4, the fourth transistor T5, the fifth transistor T6 and the sixth transistor T7 are N-type transistors. In another implementation, all of the first transistor T1, the second transistor T2, the third transistor T4, the fourth transistor T5, the fifth transistor T6 and the sixth transistor T7 are P-type transistors. In another implementation, some of the first transistor T1, the second transistor T2, the third transistor T4, the fourth transistor T5, the fifth transistor T6 and the sixth transistor T7 are N-type transistors and some of the first transistor T1, the second transistor T2, the third transistor T4, the fourth transistor T5, the fifth transistor T6 and the sixth transistor T7 are P-type transistors. The disclosure has no limitation to this, which depends on the specific conditions.

On the basis of any one of the above-described embodiments, in an embodiment of the disclosure, the potential of the first power supply signal VDD is higher than the potential of the first reference voltage Vref and the potential of the first reference voltage Vref is higher than the potential of the second power supply signal VSS, the disclosure has no limitation to this, which depends on the specific conditions.

In the following, the work principle of the pixel circuit according to the embodiment of the disclosure is explained by taking the first transistor T1, the second transistor T2, the third transistor T4, the fourth transistor T5, the fifth transistor T6, the sixth transistor T7 and the driving transistor T3 as an example.

When the first driving signal Emit1 is high, the first transistor T1 is turned on, the first power supply signal VDD input into the first electrode of the first transistor T1 is transmitted to the fourth node N4. When the first driving signal Emit1 is low, the first transistor T1 is turned off, and the conduction path between the first power supply signal VDD and the fourth node N4 is disconnected.

When the first scanning signal Scan1 is high, the second transistor T2 and the fifth transistor T6 are turned on, the second transistor T2 transmits the potential of the fourth node N4 which is electrically connected with the first electrode of the second transistor T2 to the first node N1 which is electrically connected with the second electrode of the second transistor T2, and the fifth transistor T6 transmits the first reference voltage Vref input into the second electrode of the fifth transistor T6 to the second node N2 electrically connected with the first electrode of the fifth transistor T6. When the first scanning signal Scan1 is low, the second transistor T2 and the fifth transistor T6 are turned off, the conduction path between the first node N1 and the fourth node N4 is disconnected, and the conduction path between the second node N2 and the first reference voltage Vref is disconnected.

When the second scanning signal Scan2 is high, the third transistor T4 is turned on, and the data signal Data input into the first electrode of the third transistor T4 is transmitted to the third node N3 electrically connected with the second electrode of the third transistor T4. When the second scanning signal Scan2 is low, the third transistor T4 is turned off, and the conduction path between the data signal Data and the third node N3 is disconnected.

When the second driving signal Emit2 is high, the fourth transistor T5 and the sixth transistor T7 are turned on, the conduction path between the second node N2 electrically connected with the first electrode of the fourth transistor T5 and the third node N3 electrically connected with the second electrode of the fourth transistor T5 is formed, the sixth transistor T7 transmits the potential of the third node N3 electrically connected with the first electrode of the sixth transistor T7 to the anode of the light emitting element OLED electrically connected with the second electrode of the sixth transistor T7, and the light emitting element OLED starts to work. When the second driving signal Emit2 is low, the fourth transistor T5 and the sixth transistor T7 are turned off, the conduction path between the second node N2 and the third node N3 is disconnected, and the conduction path between the third node N3 and the anode of the light emitting element OLED is disconnected, the light emitting element OLED does not work.

Correspondingly, an embodiment of the disclosure provides a driving method applied to the pixel circuit according to any one of the above embodiments. The driving method includes a reset stage, a threshold compensation stage and a light emitting stage.

In the reset stage, the first power supply signal VDD is transmitted to the gate and the drain of the driving transistor T3.

In the threshold compensation stage, the data signal Data is transmitted to the first plate of the storage capacitor Cst, the gate-source voltage of the driving transistor T3 is controlled by the storage capacitor Cst to remain constant, so that the data signal Data is transmitted to the source of the driving transistor T3.

In the light emitting stage, the driving transistor T3 generates a driving current to drive the light emitting element OLED to emit light.

Specifically, in an embodiment of the disclosure, the gate of the first transistor T1 is provided with the first driving signal Emit1, the first electrode of the first transistor T1 is provided with the first power supply signal VDD, and the second electrode of the first transistor T1 is electrically connected to a fourth node N4.

The gate of the second transistor T2 is provided with the first scanning signal Scan1, a first electrode of the second transistor T2 is electrically connected to a first node N1, and a second electrode of the second transistor T2 is electrically connected to the fourth node N4.

The gate of the driving transistor T3 is electrically connected to the first node N1, the drain of the driving transistor T3 is electrically connected to the fourth node N4, and the source of the driving transistor T3 is electrically connected to a third node N3.

The gate of the third transistor T4 is provided with the second scanning signal Scan2, a first electrode of the third transistor T4 is provided with the data signal Data, and a second electrode of the third transistor T4 is electrically connected to the third node N3.

The gate of the fourth transistor T5 is provided with the second driving signal Emit2, a first electrode of the fourth transistor T5 is electrically to a second node N2, and a second electrode of the fourth transistor T5 is electrically connected to the third node N3.

The gate of the fifth transistor T6 is provided with the first scanning signal Scan1, a first electrode of the fifth transistor T6 is electrically connected to the second node N2, and a second electrode of the fifth transistor T6 is provided with the first reference voltage Vref.

The gate of the sixth transistor T7 is provided with the second driving signal Emit2, a first electrode of the sixth transistor T7 is electrically connected to the third node N3, a second electrode of the sixth transistor T7 is electrically connected to an anode of the light emitting element OLED, and a cathode of the light emitting element OLED is provided with the second power supply signal VSS.

The first plate of the storage capacitor Cst is electrically connected to the first node N1, and the second plate of the storage capacitor Cst is electrically connected to the second node N2. The driving method includes the three stages as follows.

In the reset stage, the third transistor T4, the fourth transistor T5 and the sixth transistor T7 are controlled to turn off, and the first transistor T1, the second transistor T2 and the fifth transistor T6 are controlled to turn on, so that the potential of the first node N1 is equal to the potential of the first power supply signal VDD and the potential of the second node N2 is equal to the potential of the first reference voltage Vref.

In the threshold compensation stage, the first transistor T1, the fourth transistor T5 and the sixth transistor T7 are controlled to turn off, and the second transistor T2, the third transistor T4 and the fifth transistor T6 are controlled to turn on, so that the potential of the second node N2 keeps unchanged and the potential of the third node N3 is equal to the potential of the data signal Data; the driving transistor T3 is controlled to turn on by the storage capacitor Cst until the potential of the first node N1 is equal to the sum of the potential of the current data signal Data and the threshold voltage of the driving transistor T3, and the driving transistor is turned off after potential of the first node is equal to the sum of potential of the current data signal and the threshold voltage of the driving transistor.

In the light emitting stage, the second transistor T2, the third transistor T4 and the fifth transistor T6 are controlled to turn off, and the first transistor T1, the fourth transistor T5 and the sixth transistor T7 are controlled to turn on, so that electric charges of the storage capacitor Cst remains unchanged; the gate-source voltage of the driving transistor T3 is controlled by the storage capacitor Cst to be constant, and the light emitting element OLED is driven to emit light.

The driving method according to the embodiment of the disclosure is illustrated hereinafter in conjunction with FIG. 1 and FIG. 2. FIG. 1 a schematic diagram of a circuit structure of the pixel circuit according to the embodiment of the disclosure described above, and FIG. 2 is a timing diagram of the driving method according to the embodiment of the disclosure.

Figure 2:
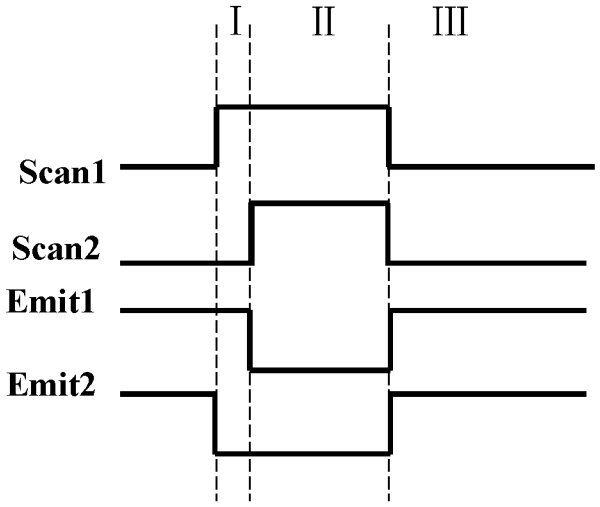
FIG. 2 is a timing diagram for driving according to an embodiment of the disclosure.

As shown in FIG. 2, in the reset stage I, the first driving signal Emit1 is high, the first transistor T1 is turned on, and the potential of the fourth node N4 is an input voltage of the first power supply signal VDD. The first scanning signal Scan1 is high, the second transistor T2 is turned on, a conduction path is formed between the first node N1 and the fourth node N4, the potential of the first node N1 and the potential of the fourth node N4 are the same, i.e, both of them are the voltage of the first power supply signal VDD, and meanwhile, the fifth transistor T6 is turned on and the potential of the second node N2 is the input potential of the first reference voltage Vref. Since the first plate of the storage capacitor Cst is electrically connected to the first node N1 and the second plate of the storage capacitor Cst is electrically connected to the second node N2, the voltage of the first plate of the storage capacitor Cst is the voltage of the first power supply signal VDD, and the voltage of the second plate is the first reference voltage Vref. The storage capacitor Cst is charged by the first power supply signal VDD until the voltage difference Vcst between the first plate and the second plate of the storage capacitor Cst is equal to the voltage difference between the voltage of the first power supply signal VDD and the first reference voltage Vref, i.e., Vcst=VDD−Vref.

The second scanning signal Scan2 and the second driving signal Emit2 are both low, the third transistor T4, the fourth transistor T5 and the sixth transistor T7 are turned off. Since the third transistor T4, the fourth transistor T5 and the sixth transistor T7 are turned off, the source of the driving transistor T3 has no input signal and the driving transistor T3 is also turned off in the reset stage I.

In the threshold compensation stage II, both of the first scanning signal Scan1 and the second scanning signal Scan2 are high, and both of the first driving signal Emit1 and the second driving signals Emit2 are low. Since the first driving signal Emit1 is low, the first transistor T1 is turned off. Since the first scanning signal Scan1 is high, the second transistor T2 and the fifth transistor T6 are turned on. The potential of the second node N2 is still the potential of the first reference voltage Vref. The potential of the fourth node N4 (the drain of the driving transistor T3) is the same as the potential of the first node N1, i.e., maintaining the VDD of the reset stage. The gate and the drain of the driving transistor T3 are electrically connected. Since the second driving signal Emit2 is low, the fourth transistor T5 and the sixth transistor T7 are turned off. The conduction path between the second node N2 and the third node N3 is disconnected. The conduction path between the third node N3 and the light emitting element OLED is also disconnected. Since the second scanning signal Scan2 is high, the third transistor T4 is turned on. The potential of the third node N3 is the input voltage Vdata of the data signal Data. Meanwhile, the potential of the gate of the driving transistor T3 is VDD, the potential of the source of the driving transistor T3 is Vdata, where VDD>Vdata. The driving transistor T3 is turned on, and the storage capacitor Cst begins to discharge until the potential of the first node N1 is equal to the sum of the potential of the third node N3 and the threshold voltage of the driving transistor T3, i.e., the potential of the first node N1 is Vdata+Vth, the voltage difference across the storage capacitor Cst is Vdata+Vth−Vref, and the driving transistor T3 is turned off after the potential of the first node N1 is equal to the sum of the potential of the third node N3 and the threshold voltage of the driving transistor T3.

In the light emitting stage III, both of the first scanning signal Scan1 and the second scanning signal Scan2 are low, and both of the first driving signal Emit1 and the second driving signal Emit2 are high. Since both of the first scanning signal Scan1 and the second scanning signal Scan2 are low, the second transistor T2 and the fifth transistor T6 are turned off, and the third transistor T4 is also turned off. Since both of the first driving signal Emit1 and the second driving signal Emit2 are high, the first transistor T1, the fourth transistor T5 and the sixth transistor T7 are turned on. After the first transistor T1 is turned on, the voltage of the fourth node N4 is VDD. After the fourth transistor T5 is turned on, the second node N2 and the third node N3 have the same potential. After the sixth transistor T7 is turned on, the potential of the third node N3 is equal to the voltage of the anode of the light emitting element OLED.

A bootstrap effect of the capacitor refers to that, when the voltage of one plate of the capacitor changes, the voltage of the other plate of the capacitor will change accordingly, in the case where there is no charging and discharging for the storage capacitor Cst, to ensure the voltage difference between the two plates to be constant. In an embodiment of the disclosure, the voltage of the second power supply signal VSS is zero, then the voltage of the first node N1 is Vdata+Vth−Vref+Voled due to the bootstrap effect of the capacitor, where Voled is the voltage of the anode of the light emitting element OLED, Vth is the threshold voltage of the driving transistor T3.

As seen from the foregoing, the driving current of the light emitting element OLED in the organic light emitting display device is in direct proportional to the square of the difference between the gate-source voltage and the threshold voltage of the driving transistor T3, i.e., Ioled ∝(Vgs−Vth)^2. In the embodiment, the gate-source voltage Vgs of the driving transistor T3 is the voltage difference between the first node N1 and the third node N3, i.e., Vgs=Vdata+Vth−Vref+Voled−Voled=Vdata+Vth−Vref, then the driving current flowing through the driving transistor T3 for driving the light emitting element OLED is Ioled∝(Vgs−Vth)^2=(Vdata+Vth−Vref−Vth)^2=(Vdata−Vref)^2.

Therefore, in the embodiment of the disclosure, the driving current flowing through the driving transistor T3 for driving the light emitting element OLED is independent of the gate-source voltage and the threshold voltage of the driving transistor T3 and the anode power supply voltage (i.e., the first power supply driving signal VDD), thereby eliminating bad effects, relieving the non-uniformity of luminance of the display panel and the display device, and improving luminance uniformity and display effect of the display image of the display panel and the display device.

In addition, in the embodiment of the disclosure, the gate of the driving transistor T3 is electrically connected to the first node N1, the source of the driving transistor T3 is electrically connected to the third node N3, and the third node N3 is electrically connected to the second node N2. Therefore, although the aging phenomenon of the light emitting element OLED during using causes the voltage of the source of the driving transistor T3 (i.e., the voltage of the third node N3) to change, the voltage of the gate of the driving transistor T3 (i.e., the voltage of the first node N1) changes by the same amount as the change of the voltage of the source of the driving transistor T3 due to the bootstrap effect of the storage capacitor Cst, thereby ensuring that the gate-source voltage of the driving transistor T3 is constant, i.e., the gate-source voltage of the driving transistor T3 does not change with changes of the performance of the light emitting element OLED. In this case, the driving current flowing through the driving transistor T3 for driving the light emitting element OLED also does not change, thereby avoiding the phenomenon of the display luminance of the display device being non-uniform and dimming due to aging of the light emitting element OLED.

An embodiment of the disclosure further provides a display panel including: pixel units arranged in an M×N array, multiple scanning lines, multiple data lines, multiple power supply signal lines, where M and N are positive integers.

The pixel unit includes the pixel circuit according to any one of the above embodiments of the disclosure. The scanning lines are parallel to a row direction of pixels. The data lines are parallel to a column direction of pixels. Each of the pixel units is electrically connected with four scanning lines, one data line and two power supply signal lines.

The four scanning lines are configured to supply a first scanning signal, a second scanning signal, a first driving signal and a second driving signal to the pixel unit. The data line is configured to supply a data signal to the pixel unit. The two power supply signal lines are configured to supply a first power supply signal and a second power supply signal to the pixel unit.

Figure 3:
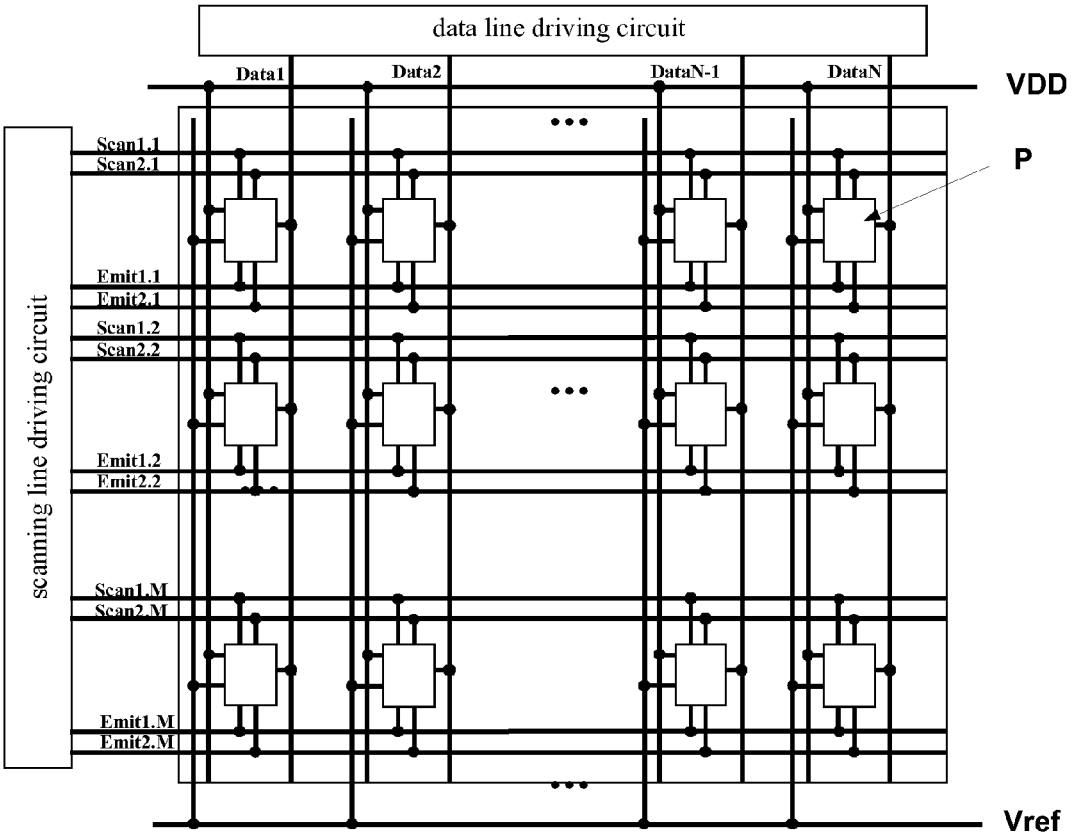
FIG. 3 is a schematic structural diagram of a display panel according to an embodiment of the disclosure.

On the basis of the above-described embodiment, in an embodiment of the disclosure, the display panel includes 4M scanning lines, and in the column direction of pixels, the 4M scanning lines include the first scanning line to the 4M-th scanning line, as shown in FIG. 3.

The pixel units P in the m-th row are electrically connected with the (4m−3)-th scanning line, the (4m−2)-th scanning line, the (4m−1)-th scanning line and the 4m-th scanning line, where m is a positive integer not greater than M.

The (4m−3)-th scanning line is configured to supply the first scanning signal Scan1 to the pixel units P in the m-th row, the (4m−2)-th scanning line is configured to supply the second scanning signal Scan2 to the pixel units P in the m-th row, the (4m−1)-th scanning line is configured to supply the first driving signal Emit 1 to the pixel units P in the m-th row, and the 4m-th scanning line is configured to supply the second driving signal Emit2 to the pixel units P in the m-th row.

On the basis of the above-described embodiment, in an embodiment of the disclosure, the display panel includes N data lines Data, and in the row direction of pixels, the N data lines include the first data line Data1 to the N-th data line DataN.

The pixel units P in the n-th column are electrically connected with the n-th data line, where n is a positive integer not greater than N.

The n-th data line is configured to supply the data signal DataN to the pixel units P in the n-th column.

On the basis of any one of the embodiments, in an embodiment of the disclosure, the power supply signal lines VDD and Vref are parallel to the column direction of pixels.

The display panel includes 2N power supply signal lines, and in the column direction of pixels, the 2N power supply signal lines include the first power supply signal line to the 2N-th power supply signal line.

The pixel units P in the n-th column are electrically connected with the (2n−1)-th power supply signal line and the 2n-th power supply signal line, where n is a positive integer not greater than N.

The (2n−1)-th power supply signal line is configured to supply the first power supply signal VDD to the pixel units P in the n-th column, and the 2n-th power supply signal line is configured to supply the second power supply signal VSS (not shown in FIG. 3) to the pixel units P in the n-th column.

In another embodiment of the disclosure, the power supply signal lines are parallel to the row direction of pixels.

The display panel includes 2M power supply signal lines, and in the column direction of pixels, the 2M power supply signal lines include the first power supply signal line to the 2M-th power supply signal line.

The pixel units in the m-th row are electrically connected with the (2m−1)-th power supply signal line and the 2m-th power supply signal line, where m is a positive integer not greater than M.

The (2m−1)-th power supply signal line is configured to supply the first power supply signal VDD to the pixel units P in the m-th row, and the 2m-th power supply signal line is configured to supply the second power supply signal VSS (not shown in FIG. 3) to the pixel units in the m-th row.

In another embodiment of the disclosure, the display panel includes M row power supply signal lines and N column power supply signal lines, the row power supply signal lines are parallel to the row direction of pixels, and the column power supply signal lines are parallel to the column direction of pixels.

In the row direction of pixels, the M row power supply signal lines include the first row power supply signal line to the M-th row power supply signal line. The m-th row power supply signal line is configured to supply the first power supply signal VDD to the pixel units P in the m-th row, where m is a positive integer not greater than M.

In the column direction of pixels, the N column power supply signal lines include the first column power supply signal line to the N-th column power supply signal line. The n-th column power supply signal line is configured to supply the second power supply signal VSS (not shown in FIG. 3) to the pixel units P in the n-th column, where n is a positive integer not greater than N.

In another embodiment of the disclosure, the display panel includes M row power supply signal lines and N column power supply signal lines, the row power supply signal lines are parallel to the row direction of pixels, and the column power supply signal lines are parallel to the column direction of pixels.

In the row direction of pixels, the M row power supply signal lines include the first row power supply signal line to the M-th row power supply signal line. The m-th row power supply signal line is configured to supply the second power supply signal VSS to the pixel units in the m-th row, where m is a positive integer not greater than M.

In the column direction of pixels, the N column power supply signal lines include the first column power supply signal line to the N-th column power supply signal line. The n-th column power supply signal line is configured to supply the first power supply signal VDD to the pixel units P in the n-th column, where n is a positive integer not greater than N.

It should be noted that, in the above embodiments of the disclosure, preferably, each power supply signal line is electrically connected to a row or a column of pixel units, to reduce the wiring of the power supply signal lines in the display device. The disclosure has no limitation to this, which depends on the specific conditions.

Figure 4:
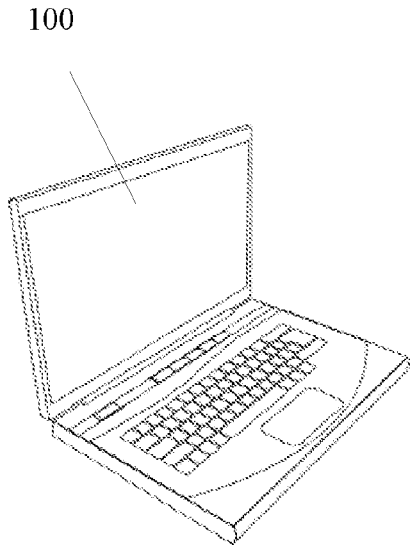
FIG. 4 is a schematic structural diagram of a display device according to an embodiment of the disclosure.

Correspondingly, an embodiment of the disclosure provides a display device including the display panel 100 according to any one of the embodiments described above, as shown in FIG. 4. The display device may be an electronic device having a display function such as a computer and a mobile phone.

In summary, in the display panel and the display device according to some embodiments of the disclosure, the driving current for driving the light emitting elements in the pixel units is independent of the gate-source voltage and the threshold voltage of the driving transistor and the anode power supply voltage (i.e., the first power supply driving signal), and does not change with the change of the performance of the light emitting element, thereby eliminating negative effects, relieving the non-uniformity of luminance of the display panel and the display device, and improving luminance uniformity and display effect of the display image of the display panel and the display device.

The description of the embodiments herein enables those skilled in the art to implement or use the present invention. Numerous modifications to the embodiments will be apparent to those skilled in the art, and the general principle herein can be implemented in other embodiments without deviation from the spirit or scope of the present invention. Therefore, the present invention will not be limited to the embodiments described herein, but in accordance with the widest scope consistent with the principle and novel features disclosed herein.

The invention claimed is:

1. A pixel circuit comprising a first transistor, a second transistor, a third transistor, a fourth transistor, a fifth transistor, a sixth transistor, a driving transistor, a storage capacitor and a light emitting element, wherein a magnitude of a driving current of the driving transistor is determined by a gate-source voltage of the driving transistor; the first transistor is controlled by a first driving signal and is configured to transmit a first power supply signal to a drain of the driving transistor;

the second transistor is controlled by a first scanning signal and is configured to transmit the first power supply signal to a first plate of the storage capacitor and a gate of the driving transistor;

the third transistor is controlled by a second scanning signal and is configured to transmit a data signal to a source of the driving transistor;

the fourth transistor is controlled by a second driving signal and is configured to transmit a voltage of the source of the driving transistor to a second plate of the storage capacitor;

the fifth transistor is controlled by the first scanning signal and is configured to transmit a first reference voltage to the second plate of the storage capacitor;

the sixth transistor is controlled by the second driving signal and is configured to transmit the driving current from the driving transistor to an anode of the light emitting element; and a cathode of the light emitting element is connected to a second power supply signal, and the light emitting element is configured to emit light in response to the driving current, wherein a gate of the first transistor receives the first driving signal, a first electrode of the first transistor receives the first power supply signal, and a second electrode of the first transistor is electrically connected to a fourth node;

a gate of the second transistor receives the first scanning signal, a first electrode of the second transistor is electrically connected to a first node, and a second electrode of the second transistor is electrically connected to the fourth node;

the gate of the driving transistor is electrically connected to the first node, the drain of the driving transistor is electrically connected to the fourth node, and the source of the driving transistor is electrically connected to a third node;

a gate of the third transistor receives the second scanning signal, a first electrode of the third transistor receives the data signal, and a second electrode of the third transistor is electrically connected to the third node;

a gate of the fourth transistor receives the second driving signal, a first electrode of the fourth transistor is electrically connected to a second node, and a second electrode of the fourth transistor is electrically connected to the third node;

a gate of the fifth transistor receives the first scanning signal, a first electrode of the fifth transistor is electrically connected to the second node, and a second electrode of the fifth transistor receives the first reference voltage;

a gate of the sixth transistor receives the second driving signal, a first electrode of the sixth transistor is electrically connected to the third node, a second electrode of the sixth transistor is electrically connected to the anode of the light emitting element, and the cathode of the light emitting element receives the second power supply signal; and the first plate of the storage capacitor is electrically connected to the first node, and the second plate of the storage capacitor is electrically connected to the second node.

2. The pixel circuit according to claim 1, wherein the driving transistor is an N-type transistor.

3. The pixel circuit according to claim 2, wherein all of the first transistor, the second transistor, the third transistor, the fourth transistor, the fifth transistor and the sixth transistor are N-type transistors.

4. The pixel circuit according to claim 3, wherein a potential of the first power supply signal is higher than a potential of the first reference voltage, and a potential of the first reference voltage is higher than a potential of the second power supply signal.

5. The pixel circuit according to claim 2, wherein the first transistor, the second transistor, the third transistor, the fourth transistor, the fifth transistor and the sixth transistor are P-type transistors.

6. The pixel circuit according to claim 5, wherein a potential of the first power supply signal is higher than a potential of the first reference voltage, and a potential of the first reference voltage is higher than a potential of the second power supply signal.

7. The pixel circuit according to claim 2, wherein a potential of the first power supply signal is higher than a potential of the first reference voltage, and a potential of the first reference voltage is higher than a potential of the second power supply signal.

8. The pixel circuit according to claim 1, wherein the light emitting element is an organic light emitting diode.

9. The pixel circuit according to claim 1, wherein a potential of the first power supply signal is higher than potential of the first reference voltage, and a potential of the first reference voltage is higher than potential of the second power supply signal.

10. The pixel circuit according to claim 1, wherein a potential of the first power supply signal is higher than a potential of the first reference voltage, and a potential of the first reference voltage is higher than a potential of the second power supply signal.

11. A driving method for driving a pixel circuit, wherein the pixel circuit comprises a first transistor, a second transistor, a third transistor, a fourth transistor, a fifth transistor, a sixth transistor, a driving transistor, a storage capacitor and a light emitting element, wherein a magnitude of a driving current of the driving transistor is determined by a gate-source voltage of the driving transistor;

the first transistor is controlled by a first driving signal and is configured to transmit a first power supply signal to a drain of the driving transistor;

the second transistor is controlled by a first scanning signal and is configured to transmit the first power supply signal to a first plate of the storage capacitor and a gate of the driving transistor;

the third transistor is controlled by a second scanning signal and is configured to transmit a data signal to a source of the driving transistor;

the fourth transistor is controlled by a second driving signal and is configured to transmit a voltage of the source of the driving transistor to a second plate of the storage capacitor;

the fifth transistor is controlled by the first scanning signal and is configured to transmit a first reference voltage to the second plate of the storage capacitor;

the sixth transistor is controlled by the second driving signal and is configured to transmit the driving current from the driving transistor to an anode of the light emitting element; and a cathode of the light emitting element is connected to a second power supply signal, and the light emitting element is configured to emit light in response to the driving current, and wherein the driving method comprises a reset stage, a threshold compensation stage and a light emitting stage, in the reset stage, transmitting the first power supply signal to the gate and the drain of the driving transistor;

in the threshold compensation stage, transmitting the data signal to the first plate of the storage capacitor, and controlling the gate-source voltage of the driving transistor to remain constant, by the storage capacitor, so that the data signal is transmitted to the source of the driving transistor; and in the light emitting stage, generating the driving current by the driving transistor to drive the light emitting element to emit light, wherein a gate of the first transistor receives the first driving signal, a first electrode of the first transistor receives the first power supply signal, and a second electrode of the first transistor is electrically connected to a fourth node;

a gate of the second transistor receives the first scanning signal, a first electrode of the second transistor is electrically connected to a first node, and a second electrode of the second transistor is electrically connected to the fourth node;

the gate of the driving transistor is electrically connected to the first node, the drain of the driving transistor is electrically connected to the fourth node, and the source of the driving transistor is connected to a third node;

a gate of the third transistor receives the second scanning signal, a first electrode of the third transistor receives the data signal, and a second electrode of the third transistor is electrically connected to the third node;

a gate of the fourth transistor receives the second driving signal, a first electrode of the fourth transistor is electrically connected to a second node, and a second electrode of the fourth transistor is electrically connected to the third node; a gate of the fifth transistor receives the first scanning signal, a first electrode of the fifth transistor is electrically connected to the second node, and a second electrode of the fifth transistor receives the first reference voltage;

a gate of the sixth transistor receives the second driving signal, a first electrode of the sixth transistor is electrically connected to the third node, a second electrode of the sixth transistor is electrically connected to the anode of the light emitting element, and the cathode of the light emitting element receives the second power supply signal;

the first plate of the storage capacitor is electrically connected to the first node, and the second plate of the storage capacitor is electrically connected to the second node; and wherein the driving method comprises:

in the reset stage, controlling the third transistor, the fourth transistor and the sixth transistor to be turned off, and controlling the first transistor, the second transistor and the fifth transistor to be turned on, so that potential of the first node is equal to potential of the first power supply signal and potential of the second node is equal to potential of the first reference voltage;

in the threshold compensation stage, controlling the first transistor, the fourth transistor and the sixth transistor to be turned off, and controlling the second transistor, the third transistor and the fifth transistor to be turned on, so that potential of the second node keeps unchanged, and potential of the third node is equal to potential of the data signal; controlling the driving transistor to be turned on by the storage capacitor until potential of the first node is equal to a sum of potential of the current data signal and a threshold voltage of the driving transistor, wherein the driving transistor is turned off after potential of the first node is equal to the sum of potential of the current data signal and the threshold voltage of the driving transistor;

in the light emitting stage, controlling the second transistor, the third transistor and the fifth transistor to be turned off, and controlling the first transistor, the fourth transistor and the sixth transistor to be turned on, so that electric charges of the storage capacitor keeps unchanged; controlling the gate-source voltage of the driving transistor to be constant by the storage capacitor and driving the light emitting element to emit light.

12. A display panel comprising: pixel units arranged in an M×N array, a plurality of scanning lines, a plurality of data lines, a plurality of power supply signal lines, wherein M and N are positive integers, wherein the pixel unit comprises a pixel circuit, and the pixel circuit comprises a first transistor, a second transistor, a third transistor, a fourth transistor, a fifth transistor, a sixth transistor, a driving transistor, a storage capacitor and a light emitting element, wherein a magnitude of a driving current of the driving transistor is determined by a gate-source voltage of the driving transistor;

the first transistor is controlled by a first driving signal and is configured to transmit a first power supply signal to a drain of the driving transistor;

the second transistor is controlled by a first scanning signal and is configured to transmit the first power supply signal to a first plate of the storage capacitor and a gate of the driving transistor;

the third transistor is controlled by a second scanning signal and is configured to transmit a data signal to a source of the driving transistor;

the fourth transistor is controlled by a second driving signal and is configured to transmit a voltage of the source of the driving transistor to a second plate of the storage capacitor;

the fifth transistor is controlled by the first scanning signal and is configured to transmit a first reference voltage to the second plate of the storage capacitor;

the sixth transistor is controlled by the second driving signal and is configured to transmit the driving current from the driving transistor to an anode of the light emitting element; and a cathode of the light emitting element is connected to a second power supply signal, and the light emitting element is configured to emit light in response to the driving current, the scanning lines are parallel to a row direction of pixels; the data lines are parallel to a column direction of pixels; each of the pixel units is electrically connected with four scanning lines, one data line and two power supply signal lines; and the four scanning lines are configured to supply the first scanning signal, the second scanning signal, the first driving signal and the second driving signal to the pixel unit;

the data line is configured to supply the data signal to the pixel unit; the two power supply signal lines are configured to supply the first power supply signal and the second power supply signal to the pixel unit, wherein a gate of the first transistor receives the first driving signal, a first electrode of the first transistor receives the first power supply signal, and a second electrode of the first transistor is electrically connected to a fourth node;

a gate of the second transistor receives the first scanning signal, a first electrode of the second transistor is electrically connected to a first node, and a second electrode of the second transistor is electrically connected to the fourth node;

the gate of the driving transistor is electrically connected to the first node, the drain of the driving transistor is electrically connected to the fourth node, and the source of the driving transistor is electrically connected to a third node;

a gate of the third transistor receives the second scanning signal, a first electrode of the third transistor receives the data signal, and a second electrode of the third transistor is electrically connected to the third node;

a gate of the fourth transistor receives the second driving signal, a first electrode of the fourth transistor is electrically connected to a second node, and a second electrode of the fourth transistor is electrically connected to the third node;

a gate of the fifth transistor receives the first scanning signal, a first electrode of the fifth transistor is electrically connected to the second node, and a second electrode of the fifth transistor receives the first reference voltage;

a gate of the sixth transistor receives the second driving signal, a first electrode of the sixth transistor is electrically connected to the third node, a second electrode of the sixth transistor is electrically connected to the anode of the light emitting element, and the cathode of the light emitting element receives the second power supply signal; and the first plate of the storage capacitor is electrically connected to the first node, and the second plate of the storage capacitor is electrically connected to the second node.

13. The display panel according to claim 12, wherein the display panel comprises 4M scanning lines, and the 4M scanning lines comprise a first scanning line to a 4M-th scanning line in the column direction of pixels, the pixel units in an m-th row are electrically connected with a (4m−3)-th scanning line, a (4m−2)-th scanning line, a (4m−1)-th scanning line and a 4m-th scanning line, wherein m is a positive integer not greater than M; and the (4m−3)-th scanning line is configured to supply the first scanning signal to the pixel units in the m-th row, and the (4m−2)-th scanning line is configured to supply the second scanning signal to the pixel units in the m-th row, the (4m−1)-th scanning line is configured to supply the first driving signal to the pixel units in the m-th row, and the 4m-th scanning line is configured to supply the second driving signal to the pixel units in the m-th row.

14. The display panel according to claim 13, wherein the display panel comprises N data lines, and the N data lines comprise a first data line to an N-th data line in the row direction of pixels, the pixel units in an n-th column are electrically connected with an n-th data line, wherein n is a positive integer not greater than N; and the n-th data line is configured to supply the data signal to the pixel units in the n-th column.

15. The display panel according to claim 12, wherein the power supply signal line is parallel to the column direction of pixels, the display panel comprises 2N power supply signal lines, and the 2N power supply signal lines comprise a first power supply signal line to a 2N-th power supply signal line in the column direction of pixels;

the pixel units in an n-th column are electrically connected with a (2n−1)-th power supply signal line and a 2n-th power supply signal line, wherein n is a positive integer not greater than N; and the (2n−1)-th power supply signal line is configured to supply the first power supply signal to the pixel units in the n-th column, and the 2n-th power supply signal line is configured to supply the second power supply signal to the pixel units in the n-th column.

16. The display panel according to claim 12, wherein the power supply signal line is parallel to the row direction of pixels, the display panel comprises 2M power supply signal lines, and the 2M power supply signal lines comprise a first power supply signal line to a 2M-th power supply signal line in the column direction of pixels;

the pixel units in an m-th row are electrically connected with a (2m−1)-th power supply signal line and a 2m-th power supply signal line, wherein m is a positive integer not greater than M; and the (2m−1)-th power supply signal line is configured to supply the first power supply signal to the pixel units in the m-th row, and the 2m-th power supply signal line is configured to supply the second power supply signal to the pixel units in the m-th row.

17. The display panel according to claim 12, wherein the display panel comprises M row power supply signal lines and N column power supply signal lines, the row power supply signal lines are parallel to the row direction of pixels, and the column power supply signal lines are parallel to the column direction of pixels, the M row power supply signal lines comprise a first row power supply signal line to an M-th row power supply signal line in the row direction of pixels, and an m-th row power supply signal line is configured to supply the first power supply signal to the pixel units in an m-th row, wherein m is a positive integer not greater than M; and the N column power supply signal lines comprise a first power supply signal line to an N-th column power supply signal line in the column direction of pixels, and an n-th column power supply signal line is configured to supply the second power supply signal to the pixel units in an n-th column, wherein n is a positive integer not greater than N.

18. The display panel according to claim 12, wherein the display panel comprises M row power supply signal lines and N column power supply signal lines, the row power supply signal lines are parallel to the row direction of pixels, and the column power supply signal lines are parallel to the column direction of pixels, the M row power supply signal lines comprise a first row power supply signal line to an M-th column power supply signal line in the row direction of pixels, and an m-th row power supply signal line is configured to supply the second power supply signal to the pixel units in an m-th row, wherein m is a positive integer not greater than M; and the N column power supply signal lines comprise a first column power supply signal line to an N-th column power supply signal line in the column direction of pixels, and an n-th column power supply signal line is configured to supply the first power supply signal to the pixel units in an n-th column, wherein n is a positive integer not greater than N.

19. A display device comprising a display panel, the display panel comprising: pixel units arranged in an M×N array, a plurality of scanning lines, a plurality of data lines, a plurality of power supply signal lines, wherein M and N are positive integers, wherein the pixel unit comprises a pixel circuit, and the pixel circuit comprises a first transistor, a second transistor, a third transistor, a fourth transistor, a fifth transistor, a sixth transistor, a driving transistor, a storage capacitor and a light emitting element, wherein a magnitude of a driving current of the driving transistor is determined by a gate-source voltage of the driving transistor;

the first transistor is controlled by a first driving signal and is configured to transmit a first power supply signal to a drain of the driving transistor;

the second transistor is controlled by a first scanning signal and is configured to transmit the first power supply signal to a first plate of the storage capacitor and a gate of the driving transistor;

the third transistor is controlled by a second scanning signal and is configured to transmit a data signal to a source of the driving transistor;

the fourth transistor is controlled by a second driving signal and is configured to transmit a voltage of the source of the driving transistor to a second plate of the storage capacitor;

the fifth transistor is controlled by the first scanning signal and is configured to transmit a first reference voltage to the second plate of the storage capacitor;

the sixth transistor is controlled by the second driving signal and is configured to transmit the driving current from the driving transistor to an anode of the light emitting element; and a cathode of the light emitting element is connected to a second power supply signal, and the light emitting element is configured to emit light in response to the driving current, the scanning lines are parallel to a row direction of pixels; the data lines are parallel to a column direction of pixels; each of the pixel units is electrically connected with four scanning lines, one data line and two power supply signal lines; and the four scanning lines are configured to supply the first scanning signal, the second scanning signal, the first driving signal and the second driving signal to the pixel unit;

the data line is configured to supply the data signal to the pixel unit;

the two power supply signal lines are configured to supply the first power supply signal and the second power supply signal to the pixel unit, wherein a gate of the first transistor receives the first driving signal, a first electrode of the first transistor receives the first power supply signal, and a second electrode of the first transistor is electrically connected to a fourth node;

a gate of the second transistor receives the first scanning signal, a first electrode of the second transistor is electrically connected to a first node, and a second electrode of the second transistor is electrically connected to the fourth node;

the gate of the driving transistor is electrically connected to the first node, the drain of the driving transistor is electrically connected to the fourth node, and the source of the driving transistor is electrically connected to a third node;

a gate of the third transistor receives the second scanning signal, a first electrode of the third transistor receives the data signal, and a second electrode of the third transistor is electrically connected to the third node;

a gate of the fourth transistor receives the second driving signal, a first electrode of the fourth transistor is electrically connected to a second node, and a second electrode of the fourth transistor is electrically connected to the third node;

a gate of the fifth transistor receives the first scanning signal, a first electrode of the fifth transistor is electrically connected to the second node, and a second electrode of the fifth transistor receives the first reference voltage;

a gate of the sixth transistor receives the second driving signal, a first electrode of the sixth transistor is electrically connected to the third node, a second electrode of the sixth transistor is electrically connected to the anode of the light emitting element, and the cathode of the light emitting element receives the second power supply signal; and the first plate of the storage capacitor is electrically connected to the first node, and the second plate of the storage capacitor is electrically connected to the second node.

* * * * *